US005188273A

United States Patent [19]

Schmoock

[11] Patent Number: 5,188,273

[45] Date of Patent: Feb. 23, 1993

[54] EXPANDER ROLLER FOR WEBS OF PAPER AND THE LIKE

[76] Inventor: Helmuth Schmoock, Buchener Weg 121, D-2058 Lauenburg/Elbe, Fed. Rep. of Germany

[21] Appl. No.: 790,130

[22] Filed: Nov. 7, 1991

Related U.S. Application Data

[63] Continuation of Ser. No. 473,284, Jan. 21, 1990, abandoned.

[30] Foreign Application Priority Data

Feb. 3, 1989 [DE] Fed. Rep. of Germany ..... 3903161

[51] Int. Cl.[5] ..... B65H 23/26; D06C 3/06

[52] U.S. Cl. ..... 226/190; 26/105; 492/30; 492/35

[58] Field of Search ..... 242/76; 226/190, 194; 29/121.1, 121.2, 121.4, 121.8; 26/99, 105

[56] References Cited

U.S. PATENT DOCUMENTS 1,728,067 9/1929 Livesey ..... 26/105
3,603,517 9/1971 McDonald et al. ..... 242/76 X
4,566,162 1/1986 Brands ..... 26/105
4,760,947 8/1988 Paquin ..... 226/190

*Primary Examiner*—Daniel P. Stodola
*Assistant Examiner*—Paul Bowen
*Attorney, Agent, or Firm*—Peter K. Kontler

[57] ABSTRACT

An expander roller for running webs of paper, textile material or the like has a straight metallic or plastic core and an outer layer consisting of two helically convoluted strips of rubber or other elastomeric material. The two convoluted webs are mirror images of each other with reference to a plane which extends between them and is normal to the axis of the core. The external surface of the outer layer is profiled in that it is provided with grooves cut into or otherwise formed in the strips and forming helices as a result of convolution of the respective strips onto the core. Each helical groove is adjacent a deformable lip which defines a portion of the external surface of the outer layer and can yield in response to engagement with a running web. The strips are permanently or detachably bonded to the peripheral surface of the core.

35 Claims, 3 Drawing Sheets

EXPANDER ROLLER FOR WEBS OF PAPER AND THE LIKE

This application is a continuation, of application Ser. No. 07/473,284, filed Jan. 21, 1990, now abandoned.

BACKGROUND OF THE INVENTION

The invention relates to expander rollers (also called rotary stretchers) for webs of paper, textile material, foil or the like.

Expander rollers are used to treat webs of flexible material which are being paid out by supply rolls and/or during winding of webs onto takeup rolls. As a rule, an expander roller has a core of metallic or other suitable material and an outer layer which has an external web-engaging surface designed to stretch the adjacent portion of the running web in response to rotation of the core. The purpose of the expander roller is to preferably stretch the running web in a direction from the center toward both marginal portions in order to eliminate folds, creases and/or other irregularities or to prevent the development of such irregularities. Many types of webs, such as paper webs, webs of textile material webs of metallic or plastic foil, webs of interlaced fibers (e.g., fleece) and the like cannot be processed at all if they develop longitudinally extending and/or otherwise oriented fold lines, creases and/or other unevennesses. An expander roller applies to the adjacent portion of the running web forces acting in the axial direction of the core, or having components extending in such direction, to ensure that the width of the running web increases or tends to increase in order to eliminate creases, fold lines or similar irregularities (hereinafter called creases for short) or to prevent the development of creases while the web is being advanced from a preceding station to the next-following station.

As a rule, the external surface of the outer layer of a conventional expander roller has one or more helical profiles, preferably two profiles which are mirror images of each other with reference to a plane extending between the two profiles at right angles to the axis of the core. Thus, the lead or pitch of one of the profiles is that of a right-hand thread and the lead of the other profile is that of a left-hand thread. Each profile tends to expand the material of a running web from the center toward the respective marginal portion. It is also known to provide the outer layer of a standard expander roller with a single helical profile; such configuration of the external surface of the outer layer also furnishes a desirable stretching or expanding action at right angles to the direction of advancement of the web.

In accordance with a heretofore known proposal, the helical profile or profiles are obtained by grinding or otherwise machining one or more helical grooves into the external surface of a one-piece outer layer which surrounds the core of the expander roller. The outer layer often consists of rubber. Such expander rollers exhibit the advantage that the outer layer produces a highly satisfactory expanding or stretching action and that the core can be driven in a rather simple and inexpensive way in contrast to the cores of certain other conventional expander rollers which employ arcuate cores and arcuate outer layers, i.e., wherein transverse stretching of the running web is achieved as a result of training the web over a roller having a curved axis.

A drawback of conventional straight expander rollers with outer layers of rubber or the like is that the machining of profiles into the external surfaces of the outer layers is a time-consuming and costly procedure. Moreover, the versatility of such rollers is not entirely satisfactory, i.e., a particular roller is capable of stretching only a single web or a series of webs having a certain width, a certain thickness, a certain flexibility or being in contact with a predetermined percentage of the external surface of the outer layer. Therefore, it is necessary to store a substantial supply of discrete expander rollers in order to ensure that a proper roller will be available when the treatment of webs of one type is completed and the machine or apparatus employing one or more expander rollers is to be set up for the processing of different types of webs.

It was further proposed to replace the one-piece outer layer of rubber or the like with an outer layer which consists of or contains a helically convoluted strip or band. The exposed side of the convoluted band has a longitudinally extending protuberance which constitutes a helix and engages the running web of textile or other material in the course of a stretching operation. The protuberance further serves as a reinforcing rib for the major portion of the strip or band which is convoluted onto the core of such expander roller. A drawback of this proposal is that the making of a band or strip with a protuberance involves considerable expenses. Furthermore, the outwardly projecting helical protuberance of the convoluted strip or band is likely to damage or deface a relatively thin and sensitive running web of paper, foil or the like. Therefore, such expander rollers failed to gain widespread acceptance in textile, paper making, paper processing and other industries where webs of paper or other flexible material must be convoluted onto or unwound from rolls or reels without the development of creases or for the express purpose of eliminating existing creases.

OBJECTS OF THE INVENTION

An object of the invention is to provide a novel and improved expander roller or rotary stretcher for running webs of flexible material which is more versatile and less expensive than, but at least as effective as, heretofore known expander rollers.

Another object of the invention is to provide a novel and improved outer layer for the above outlined expander roller.

A further object of the invention is to provide an expander roller which can be utilized as a superior substitute for existing expander rollers.

An additional object of the invention is to provide an expander roller which is designed in such a way that its rotary core can remain installed in a machine frame while the previously used outer layer is replaced with a different outer layer.

Still another object of the invention is to provide an expander roller which can conform its stretching or expanding action to the characteristics of a running web in automatic response to changes of such characteristics, particularly tension, thickness, flexibility, the extent of crimping and others.

A further object of the invention is to provide a novel and improved method of securing the outer layer to the core of the above outlined expander roller.

Another object of the invention is to provide an expander roller wherein the outer layer can be permanently or detachably applied to the peripheral surface of the core.

A further object of the invention is to provide a novel and improved straight expander roller.

An additional object of the invention is to provide an expander roller which can treat running webs gently but is nevertheless capable of eliminating creases from or of preventing the development of creases in relatively stiff as well as in readily flexible and readily stretchable webs of paper, textile material, metallic foil, plastic foil or the like.

SUMMARY OF THE INVENTION

The invention is embodied in an expander roller which comprises a substantially cylindrical and preferably straight core having a peripheral surface, and an outer layer which surrounds the peripheral surface of the core and includes at least one helically convoluted strip (e.g., a strip of rubber or elastic plastic material). The outer layer has a substantially cylindrical external surface, and the external surface has a profile which is composed of at least one groove, particularly a helical groove. The outer layer can comprise two helically convoluted strips which are substantial mirror images of each other with reference to a plane extending between the two strips and is normal to the axis of the core.

Each strip has two lateral surfaces which extend from the external surface of the outer layer to the peripheral surface of the core and which preferably converge toward each other in a direction toward the peripheral surface so that each strip has a substantially trapezoidal cross-sectional outline. Each groove preferably extends from the external surface of the outer layer toward but short of the peripheral surface of the core, and each strip preferably comprises at least one lip which is adjacent the respective groove and constitutes that portion of the respective strip which is disposed between the groove and the external surface of the outer layer. Each strip has two internal surfaces which flank the respective groove. One internal surface is adjacent the respective lip and makes an acute angle with the external surface of the outer layer. Such angle is preferably between 30 and 50 degrees. Each lip is deformable in response to engagement with a running web of paper, textile or other material which is to be expanded or stretched as a result of engagement with the external surface of the outer layer while the core is being driven to rotate about its axis. Each lip is preferably spaced apart from the core, and each lip can include a rather pronounced edge adjacent the external surface of the outer layer.

Each groove can have a substantially triangular cross-sectional outline, and its width preferably decreases in a direction from the external surface of the outer layer toward the peripheral surface of the core. The width of each groove at the external surface (as measured in the axial direction of the core) is or can be between 0.8 and 1.5 mm. The other internal surface of each strip in the respective groove is preferably straight (as seen in a direction from the external surface of the outer layer toward the peripheral surface of the core). That portion of each lip which is adjacent the external surface of the outer layer and includes the aforementioned edge is or can be readily deformable, and the external surface can have a concave portion adjacent each lip. The concave portion of the external surface extends radially outwardly beyond the main portion of such external surface (i.e., away from the axis of the core) through a distance of approximately 0.2 to 0.7 mm. Such concave portion preferably slopes gradually from the main portion of the external surface toward the edge of the respective lip.

The readily deformable portion of each lip is preferably movable toward and away from the other internal surface of the respective strip when the lip oscillates while the expander roller is in actual use. The two internal surfaces in each groove preferably make a small acute angle. The width or thickness of the outer layer in the radial direction of the core can be less, for example, much less, than the diameter of the core. For example, such width or thickness can be in the range of approximately 6 and 12 mm. Each groove can be machined into the respective strip, e.g., by partially slitting the strip with a knife or the like.

The profile of the external surface of the outer layer can be composed of a plurality of parallel grooves. For example, each strip can be formed with two parallel helical grooves. The grooves of each strip are or can be at least substantially identical. If each strip has two grooves, the open side of one groove can be provided in one lateral surface of the respective strip adjacent the external surface of the outer layer, and the other groove extends from the external surface toward but short of the other lateral surface of the respective strip. The minimum distance between neighboring grooves of a strip can equal or approximate the distance of the second groove from the other lateral surface of the respective strip. The spacing between the open sides of the grooves of a strip at the external surface of the outer layer is preferably selected in dependency upon the characteristics of the web or sheet which is to be expanded by the improved roller. For example, the spacing between the open sides of the grooves in a strip can be selected as a function of the thickness and/or flexibility of the web. Furthermore, the lead of each helically convoluted strip and of its groove or grooves as well as of its lip or lips can be selected as a function of characteristics of the material of the web which is to be stretched or expanded by the roller. Furthermore, the lead of each helically convoluted strip can be selected as a function of the diameter of the core.

The distance between the innermost portion of each groove and the peripheral surface of the core is or can be in the range of 2 to 6 mm. The distance between the lateral surfaces of each strip can be selected in dependency upon the number of grooves in the strip. For example, the distance will be 5 to 30 mm (preferably 5 to 10 mm) if the strip has a single groove and is preferably between 12 and 30 mm if the strip has several (for example, two) grooves.

As mentioned above, if the outer layer is composed of two strips, such strips can be mirror images of each other. However, it is equally possible to convolute two or more strips in the same direction and with the same lead so that the strips are disposed end to end. It is normally preferred to convolute the strips in such a way that the lead of one of the strips deviates from the lead of the other strip; for example, one of the leads is a right-hand lead and the other lead is a left-hand lead.

Each strip can contain or can consist of rubber or other (e.g., plastic) elastomeric material. Means can be provided for bonding the strip or strips to the peripheral surface of the core.

The novel features which are considered as characteristic of the invention are set forth in particular in the appended claims. The improved expander roller itself, however, both as to its construction and the mode of making and using the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
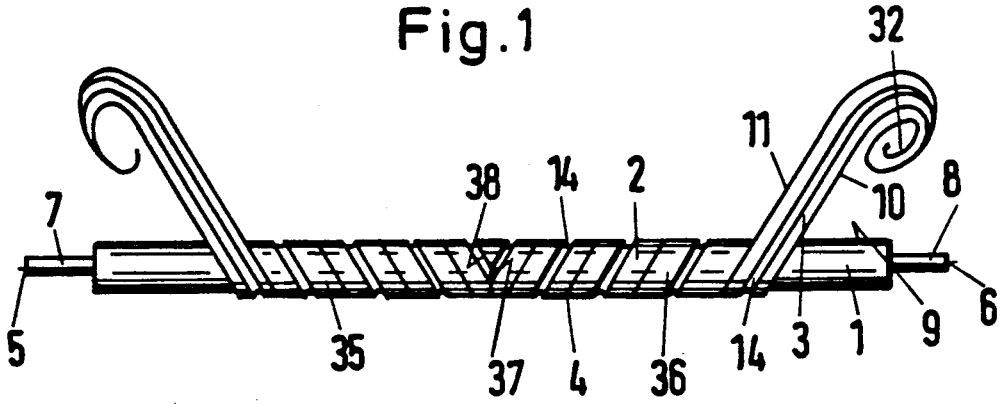
FIG. 1 is an elevational view of a core and of two discrete strips which are partially convoluted onto the core.
Figure 2:
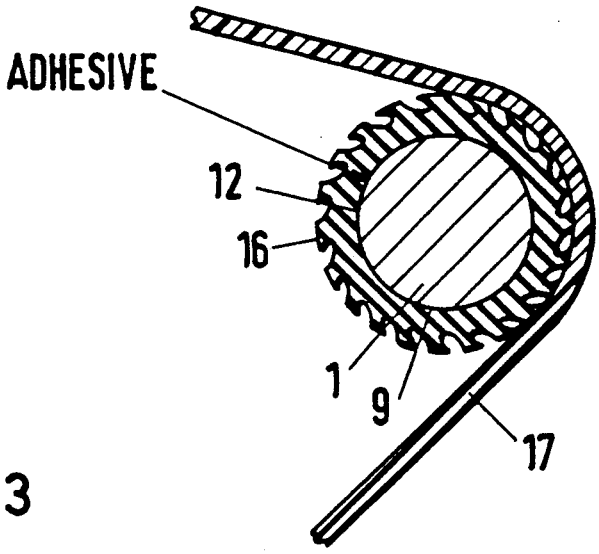
FIG. 2 is a transverse sectional view of the assembled expander roller and a fragmentary longitudinal sectional view of a running web.

The improved expander roller comprises an elongated rotary core 1 having a cylindrical peripheral surface 9, and an outer layer 2 composed of two helically convoluted strips 3. The lateral surfaces 10, 11 of each strip 3 are immediately adjacent each other or abut at 4 to form two helices which are mirror symmetrical to each other with reference to a plane extending at right angles two strips. The ends 5, 6 of the core 1 are provided with smaller-diameter stubs 7, 8 which can be installed in bearings (not shown) forming part of the frame of a machine in which the improved expander roller is put to use.

Figure 5:
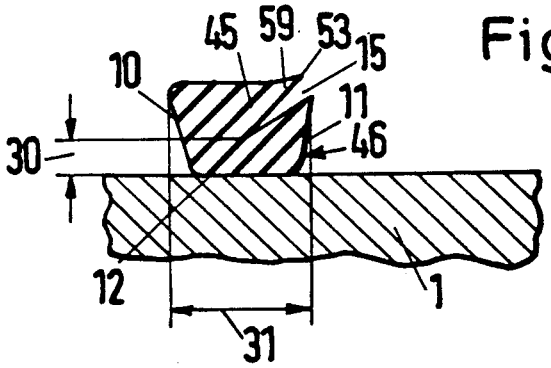
FIG. 5 is an enlarged fragmentary, axial sectional view of the core and of one convolution of a strip convoluted onto the peripheral surface of the core and has a single groove.

As can be seen in FIG. 5, the lateral surfaces 10, 11 of each of the illustrated strips 3 converge slightly toward each other in a direction from the at substantially cylindrical external surface 16 of the outer layer 2 toward the peripheral surface 9 of the core 1, and the inner side 12 of each strip 3 is bonded to the adjacent portion of the external surface 9 by a suitable adhesive indicated by a legend. Each of the strips 3 has a substantially trapezoidal outline 46.

In accordance with a feature of the invention, each strip 3 is provided with at least one groove 15 which has a triangular cross-sectional outline (in undeformed condition of the outer layer 2) and extends from the external surface 16 toward but short of the peripheral surface 9, i.e., toward but short of the inner side 12 of the respective strip. The grooves 15 impart to the external surface 16 of the outer layer 3 a profile 14 which induces a web 17 of textile, paper, foil or other material to expand, i.e., to increase (or to tend to increase) its width and to thereby eliminate or at least render less pronounced any fold lines, creases and/or other irregularities which could affect the appearance and/or further treatment of the web. Each groove 15 is adjacent a lip 45 which extends between an inner surface 57 of the respective strip 3 and the external surface 16 and has a rather pronounced helical edge 53 at the external surface 16. Those portions of each lip 45 which are immediately adjacent the respective edge 53 are readily deformable and can be flexed toward and away from the second internal surface 55 in the respective groove 15. The angle 52 (FIG. 4) between the external surface 16 and the adjacent internal surface 57 (in undeformed condition of the outer layer 2) is a relatively small acute angle, e.g., an angle between 30 and 50 degrees. The magnitude of the angle 52 depends upon the extent of stretching of the respective strip 3 during winding onto the peripheral surface 9 of the core 1.

The reference character 54 denotes the length of the internal surface 57 in a direction from the external surface 16 toward the peripheral surface 9. The distance 30 between the deepmost point 63 of a groove 15 and the peripheral surface 12 depends on a number of factors but is generally between 2 and 6 mm. Those portions (one shown at 59 in FIG. 5) of the external surface 16 of the outer layer 2 which are immediately adjacent the edges 53 of the deformable lips 45 have a concave outline and slope gently in a direction outwardly and away from the main or major portion of the external surface 16 through a distance of preferably 0.2 to 0.7 mm. The portions 59 of the external surface 16 are moved toward the axis of the core 1 when the improved roller is in actual use, i.e., when the external surface 16 is engaged by a running web 17. This can be seen in FIG. 4, as at 58, i.e., the concave portions 59 of the external surface 16 become cylindrical and are coplanar with the adjacent portions of the major part of the surface 16.

The width of the open end of each groove 15 at the external surface 16 of the outer layer 2 in undeformed condition of this outer layer is preferably between 0.8 and 1.5 mm. The angle 62 (FIG. 4) between the internal surfaces 55 and 57 in each groove 15 is preferably a small or very small acute angle, e.g., an angle of less than 15 degrees. The internal surface 57 and/or 55 are or can be straight (as seen in the direction from the external surface 16 toward the peripheral surface 9) in undeformed condition of the outer layer 2.

The elasticity of the readily deformable portion of each lip 45 in the region of the respective edge 53 is preferably sufficiently pronounced to enable such readily deformable portion to move back and forth toward and away from the respective internal surface 55 in actual use of the expander roller, i.e., when the external surface 16 is engaged by a running web 17 and the latter alternately deforms and releases successive increments of each lip 45.

The aforediscussed distance 30 between the deepmost portion 63 of a groove 15 and the peripheral surface 9 of the core 1 is selected with a view to ensure that the respective strip 3 is not likely to break or crack between the deepmost portion 63 and its inner side 12 as a result of repeated flexing of the adjacent lip 45 by the running web 17 in actual use of the improved expander roller.

The thickness 60 of the outer layer 2 (i.e., the distance between the peripheral surface 9 and the external surface 16) depends upon the elasticity of the material of the outer layer 2 and is preferably between approximately 6 and 12 mm.

The lead of convolutions 18 and 19 (FIG. 3) of the strips 3 depends upon the width of such strips (i.e., on the distance 31 between the respective lateral surfaces 10 and 11). The lead of the convolutions 18 and 19 is less pronounced if each of the strips 3 is provided with a single groove 15. FIG. 4 shows that each of the strips 3 can be provided with a plurality of grooves including the aforediscussed groove 15, a second groove 64 adjacent a lip 48, and a third or median groove 115 adjacent a lip 145. The lead of a convoluted strip 3 which has several grooves is or can be more pronounced than that of a strip having a lesser number of grooves. Each groove has an open side at the external surface 16, and the shortest distance between two neighboring grooves (15, 115 or 115, 64) in a strip 3 preferably equals or approximates the distance of the deepmost portion of the groove 64 from the adjacent lateral surface 10. Each groove 15 of FIG. 4 is provided in the lateral surface 11 of the respective strip 3 adjacent the external surface 16 of the outer layer. The grooves of each strip 3 are parallel to each other and can have identical cross-sectional outlines in undeformed condition of the respective strip. The provision of two or more grooves enhances the elasticity of the respective strip 3 in the region of the external surface 16 of the outer layer 2 which is composed of one, two or more helically convoluted strips. The mutual spacing 65 (FIG. 4) of open sides of neighboring grooves in a strip 3 (and hence the distance of each groove 64 from the lateral surface 10 of the respective strip) depends upon certain parameters of the web 17, particularly on the flexibility and thickness of the web. The spacing 65 is less if the web 17 to be treated is thin and/or readily flexible. The thickness and/or flexibility of the web 17 further determines the lead of the convolutions 18, 19 which form the outer layer 2.

The distance 31 between the lateral surfaces 10 and 11 of a strip 3 can be between 5 and 30 mm. If a strip 3 has two grooves, the distance 31 between its lateral surfaces 10 and 11 can be between 12 and 30 mm; on the other hand, the width of a strip having a single groove (see FIG. 5) need not exceed 10 mm and preferably should not be less than 5 mm.

Figure 3:
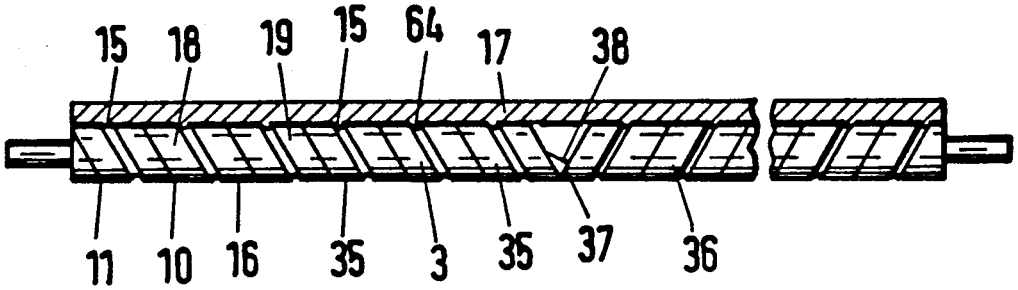
FIG. 3 is an elevational view of the assembled expander roller and a transverse sectional view of a web.
Figure 4:
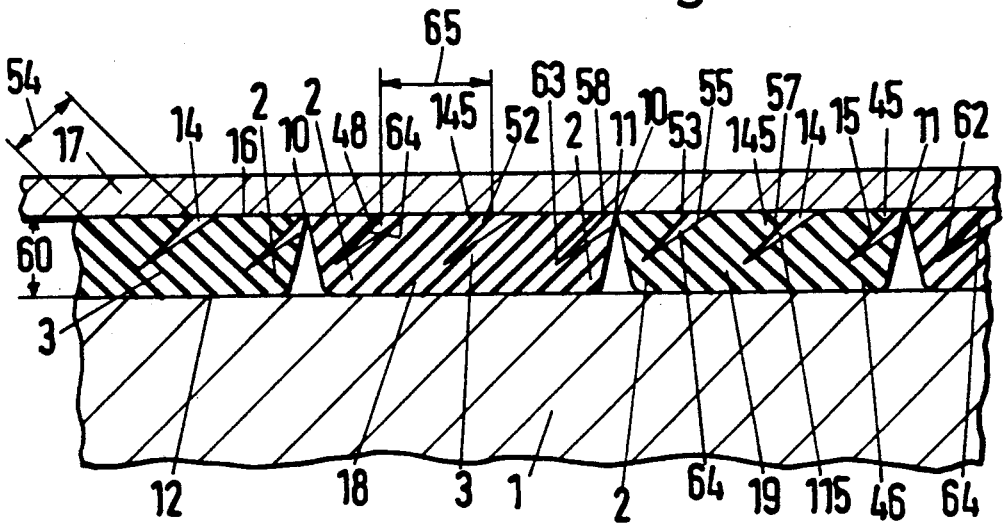
FIG. 4 is an enlarged fragmentary axial sectional view of the expander roller and of a web which is in contact with the external surface of the outer layer of the roller.

FIG. 3 shows that the convolutions 18 and 19 of one of the two strips 3 form one half 35 and the convolutions of the other strip 3 together form the other half 36 of the outer layer 2. The symmetry plane between the two halves 35, 36 is normal to the axis of the core 1 and is or can be located midway between the two ends 5, 6 of the core. The lead of convolutions 18, 19 in one of the halves 35, 36 is a left-hand lead and the other lead is a right-hand lead. This enhances the ability of the external surface 16 of the outer layer 2 to spread the running web 17 in the axial direction of the roller, namely from the center (where the two halves 35, 36 abut) toward the respective ends 5, 6 of the core 1. The abutting ends of the two halves 35, 36 of the outer layer 2 are shown in FIG. 3, as at 37 and 38.

It is equally within the purview of the invention to employ an outer layer which consists of a single strip or of three or more strips. The lead of convolutions of two or more strips can be identical or different.

The material of each strip 3 is preferably elastic. Such strips can be made of rubber or an elastomeric plastic material. As mentioned above, the inner sides 12 of the strips 3 are or can be bonded to the peripheral surface 9 of the core by resorting to a suitable adhesive. It is preferred to subject the peripheral surfaces 9 to a suitable treatment which ensures reliable retention of one or more convoluted strips 3 on the core 1. For example, the peripheral surface 9 can be roughened by sand blasting or in any other suitable way preparatory to the application of one or more films of adhesive which is to bond the strip or strips 3 to the core 1. However, it is also possible to provide the core 1 with a very smooth (e.g., highly polished) peripheral surface 9 if the nature of the bond between the core and the outer layer 2 is such that the convolutions of the strip or strips 3 will properly adhere to a smooth surface.

The stretching or expanding action of the outer layer 2 depends on the hardness of its material. As a rule, the hardness of the material of the outer layer 2 is between 35 and 45 Shore.

The core 1 can be made of steel or another metallic material (e.g., aluminum or an aluminum alloy). It is also possible to make the core 1 of a non-metallic material, e.g., hard rubber.

The method of making the improved roller is as follows: The number of grooves in each strip 3 is selected in dependency on the desired lead of the profiles 14 in the respective half of the external surface 16. The stubs 7, 8 of the core 1 are then mounted in a machine (e.g., a lathe) which can rotate the core about its axis. The peripheral surface 9 is treated in the aforedescribed manner to ensure the establishment of a reliable bond between the core 1 and the inner side 12 of each strip 3. For example, the surface 9 can be sand blasted prior to the application of one or more films of adhesive (e.g., by spraying or by means of one or more brushes). The exact composition of the adhesive will depend upon the finish of the surface 9 and on the nature of the material of the strip or strips 3 as well as on the desired quality of the bond between the core and the outer layer.

If the outer layer 2 is to be composed of a single strip 3, such strip is convoluted onto the rotating core 1 starting at one of the ends 5, 6 and proceeding toward the other end. If the outer layer 2 is to be assembled of two convoluted strips 3, the ends 37, 38 of the respective strips are affixed to the median portion of the peripheral surface 9 (FIG. 3) and the two strips are then convoluted in a manner as shown in FIG. 1, i.e., in directions toward the respective ends of the core. The two strips 3 can be convoluted onto the core 9 simultaneously or one after the other. The tensioning of strips 3 during winding onto the core 1 will determine the extent to which the edges 53 of the lips 45, 48, 145 project beyond the major portion of the external surface 16 when the making of the outer layer 2 is completed and prior to deformation of such lips by a running web 17. The exact configuration of the external surface 16 in undeformed condition of the outer layer 2 will depend upon the characteristics of the web 17 which is to be treated by the respective expander roller. The selected tensioning of a strip 3 during winding onto the core 1 determines the elasticity of its lip or lips, i.e., the elasticity of the lip or lips is less pronounced if the strip which is being convoluted onto the core 1 is subjected to a pronounced tensional stress.

The end 37 of the left-hand half 35 of the outer layer 2 of FIG. 3 can be trimmed prior to attachment of the end 38 of the other strip 3 if the two strips are convoluted onto the core one after the other. The tensioning of the second strip 3 (during winding onto the core 1) is preferably identical to the tensioning of the first strip. The strips 3 are severed (at 5 and 6) when the making of the respective halves 35, 36 of the outer layer 2 is completed.

If a machine is used for the treatment of different types of webs 17, it can be furnished with two or more identical cores 9 each of which carries a different outer layer 2. This renders it possible to simply replace a first expander roller with a different second expander roller if the machine is to be set up for the unwinding, conveying, winding and/or other treatment of different webs each of which is to be stretched or expanded by a different outer layer 2.

If a machine is to employ a very long and heavy expander roller, the core 1 of such roller can be installed in the machine at the locus of use of the assembled roller, and the strip or strips 3 are convoluted onto the thus installed core. An advantage of such procedure is that it is not necessary to employ specially designed lathes or other machines for temporary installation and rotation of a very long and heavy core; instead, such core is rotated by the drive which is used to rotate the fully assembled expander roller in a paper making plant, in a textile factory or in another establishment wherein webs of paper, textile, foil or other material are to be convoluted on rolls, paid out by rolls and/or otherwise treated or manipulated and the treatment or manipulation involves elimination of creases or analogous irregularities and/or prevention of development of such irregularities in the webs.

Figure 6:
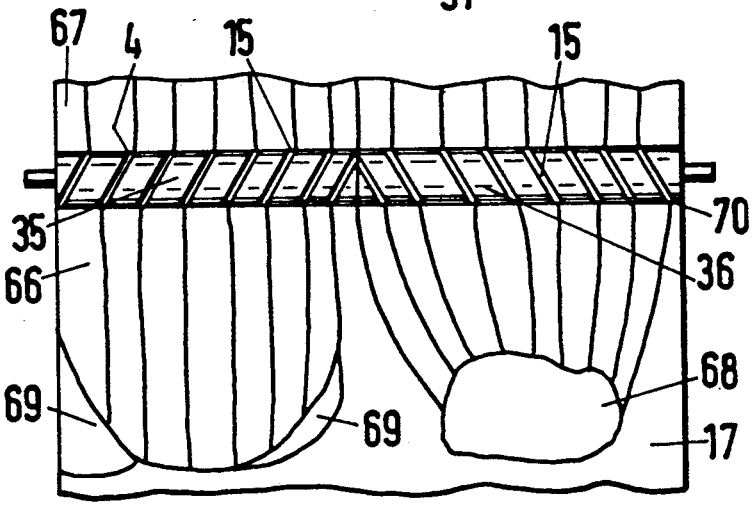
FIG. 6 is an elevational view of an expander roller in front of a web which is being stretched by the profiled outer layer of the roller.
Figure 5A:
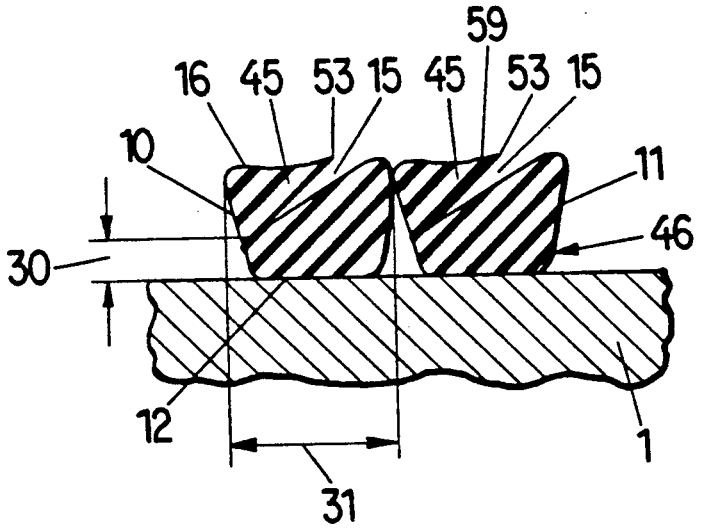
FIG. 5*a* is a sectional view similar to that of FIG. 5 but showing two strips.

FIG. 6 shows the effect of the improved expander roller upon a running web 17. The latter is assumed to run upwardly, as seen in FIG. 6, so that the irregularities 68, 69 in the web portion 66 ahead of the stretching station disappear or become less pronounced as a result of engagement by the external surface of the roller, and the web portion 67 downstream of the expander roller is devoid of creases or the creases are less pronounced and are uniformly or nearly uniformly distributed across the width of the treated web. The elimination or flattening and distribution of irregularities 68, 69 is attributable to the provision of grooves (the grooves 15 are shown in FIG. 6) as well as to the provision of the adjacent lips 45. The grooves 15 and the lips 45 further eliminate or uniformly distribute internal stresses (if any) in the running web 17. Internal stresses in the web portion which is about to contact the external surface of the outer layer 2 (at 70 in FIG. 6) are uniformly distributed at the open sides of the grooves 15, and the irregularities 68, 69 are eliminated or weakened and distributed across the width of the web under the action of the lips 45. The lips undergo deformation to vary the width of open sides of the adjacent grooves 15, and such deformation of the lips 45 ensures predictable elimination or desirable uniform distribution of internal stresses in the oncoming portions of the running web. At the same time, the lips 45 stretch or expand the running web in directions from the center of the roller toward both ends of the core 1 with attendant elimination or weakening and distribution of irregularities 68 and 69. Extensive flexing of the lips 45 will influence the running web 17 in a number of ways, such as by bringing about the aforediscussed stretching with attendant at least substantial elimination of irregularities as well as by eliminating or homogeneously distributing internal stresses in the material of the running web.

An important advantage of the improved expander roller is its simplicity. Thus, the strip or strips 3 can be pretreated (formed with one or more grooves of desired inclination, depth and width) prior to winding onto the core 1. This is simpler and less expensive than the grinding or other machining of grooves into the external surface of a one-piece hollow cylindrical outer layer which already surrounds the core. The adhesive which is used to bond the strip or strips 3 to the core 1 can be selected with a view to permit removal of the outer layer preparatory to treatment of the peripheral surface 9 for reception of a different outer layer. This, too, contributes to versatility of the improved roller and reduces the overall cost of the machine in which the roller is put to use. The strip or strips 3 can be mass-produced in an available extruding machine which can turn out considerable lengths of strip material per unit of time. All this contributes to lower cost of the improved roller. Replacement of a first outer layer 2 with a fresh outer layer wherein the external surface 16 has a different profile which is best suited for the treatment of a particular web can be completed at a small fraction of the cost of a new expander roller, particularly a conventional roller wherein the core must be provided with a homogeneous one-piece outer layer of rubber or the like and the external surface of such outer layer must be treated in a grinding or other material removing machine to provide a profile which is capable of stretching a running web.

The diameter of the external surface 16 of the improved roller can be selected in dependency upon the characteristics of the web 17 by the simple expedient of utilizing one or more thicker or thinner strips 3 and/or by properly selecting the tensional stress upon the strip or strips during winding onto the core 1.

It has been found that the improved expander roller can be used for highly satisfactory treatment of all kinds of running webs including webs made of any one of a variety of different materials as well as wide or narrow webs and readily flexible or relatively stiff and relatively thin and relatively thick webs. The running web can be maintained in large-area contact with the outer layer 2 because the lips of the outer layer are or can be readily deformable. This is particularly desirable when the improved roller is to treat a relatively thin and readily flexible web which would be likely to develop pronounced creases, fold lines and/or other irregularities as a result of engagement with rigid radially outwardly projecting portions of the outer layer. The open sides of the grooves 15 and/or additional grooves permit entry of irregularities (such as those shown at 68 and 69 in FIG. 6) to thereupon distribute the irregularities all the way between the two marginal portions of the web and to thus contribute to the development of less pronounced irregularities or to render the treated portion of the web devoid of any creases or the like. Furthermore, uniform distribution of internal stresses across the width of the running web reduces or terminates the tendency of the web to develop creases or other irregularities on its way beyond the improved expander roller, e.g., toward and onto the core of a takeup reel.

The convolutions of each strip 3 on the peripheral surface 9 of the core 1 are preferably immediately or very closely adjacent each other so that the external surface 16 of the thus obtained outer layer 16 is a cylindrical surface which is interrupted only at the locations of intentional profiling, i.e., in the regions of open sides of the grooves in the strips 3. The outwardly extending portions 59 of the lips (at the respective edges 53) are first to be contacted by the adjacent side of a running web 17. Thus, such lips can eliminate or distribute internal stresses even before the web reaches and engages the major portion of the external surface 16. The distribution of internal stresses is completed not later than when an increment of the running web advances beyond the external surface 16. As mentioned above, this greatly reduces or terminates the tendency of the web to develop fresh wrinkles, creases, fold lines and/or other irregularities.

The lips of the outer layer 2 react to characteristic vibrations of the running web 17. Such characteristic vibrations depend on the length of unsupported portion of the web upstream and/or downstream of the expander roller. Furthermore, characteristic and other vibrations of the running web depend upon the extent to which the web is guided and restrained against stray movements on its way toward the roller and/or upon the extent (if any) to which the roller is running out of true.

As mentioned above, it is possible to form the entire outer layer 2 from a single strip 3 or from three or more strips. The utilization of two strips 3 and the winding of two strips in a manner as shown in FIG. 1, 3 and 6 is preferred at this time for three important reasons, namely: The two mirror symmetrical halves 35, 36 of the outer layer 2 ensure a highly satisfactory and uniform stretching of the running web 17 from the abutting ends 37, 38 of the strips 3 at the center of the roller toward both ends of the core 1. Furthermore, the two helical grooves 15 or the two sets of helical grooves ensure a desirable distribution and homogenization of internal stresses even before the running web 17 comes into large-area contact with the external surface 16 of the outer layer 2. Moreover, the flexible lips of the outer layer produce a desirable damping action of the locus (70) of initial contact with the running web 17 and at the locus where the web advances beyond the external surface 16.

The shape of the lips depends upon a variety of factors, such as the diameter of the external surface 16, the tension of the strip or strips 3 during winding onto the core 1, and the material of the strip or strips. Some or all of these factors are taken into consideration during making of the improved roller in order to ensure optimal treatment of the webs. Moreover, it is possible to balance various parameters in order to enhance the versatility of the roller, i.e., a relatively small number of rollers will suffice to ensure adequate treatment of any one of a variety of different webs, such as thick or thin webs, wide or narrow webs, strongly creased or relatively smooth webs, webs which are accurately guided during advancement toward contact with the outer layer of the selected roller and/or webs having long unsupported stretches ahead of the expanding or stretching station.

The lead of convolutions on the core 1 will depend on the width of the strip or strips which are used to make the outer layer 2. Another factor which determines the lead of convolutions (and hence the stretching action) is the hardness or elasticity of the material of the strip or strips. The roller is ready for use as soon as the strip or strips are applied to and adhere to the peripheral surface 9 of the core 1, i.e., it is not necessary to subject the thus obtained outer layer 2 to any additional treatment. The roller can be inserted into and removed from the frame of the web treating machine as often as desired without any alterations of the roller and/or of other parts of the machine. A roller can be maintained in a position of readiness to replace the previously used roller as soon as the treatment of a particular web or a series of identical or similar webs is completed.

It is further within the purview of the invention to employ strips 3 which have exactly parallel lateral surfaces 10 and 11. It is presently preferred to employ strips with convergent lateral surfaces (i.e., strips wherein the width 31 at the external surface 16 of the finished outer layer 2 is greater than the width of the inner sides 12) because such strips render it possible to form an external surface 16 which is interrupted only and alone where actually desired, i.e., at the gaps which are intentionally provided in the strips prior to winding of such strips onto the core 1. This is particularly important when the strip or strips 3 are relatively narrow so that they would tend to bulge outwardly at the external surface 16 of the finished outer layer 2, especially if the lead of the convoluted strips is rather pronounced. As a rule, neighboring convolutions of a strip 3 which surrounds the core 1 will be placed close to each other so that the lateral surface 10 abuts the lateral surface 11, at least in the region of the external surface 16. This reduces the tendency of neighboring convolutions of a web 3 to shift relative to each other upon completion of the outer layer. The extent of frictional engagement between abutting surfaces 10, 11 on neighboring convolutions of a strip 3 can be selected with a view to avoid any undesirable stray movements of portions of the strip or strips relative to the core. However, it is also possible to intentionally design the outer layer 2 in such a way that the neighboring convolutions of each strip 3 define clearances of selected width. Such clearances can act not unlike additional gaps or slots.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An expander roller comprising a substantially cylindrical core having a peripheral surface; and an outer layer surrounding said peripheral surface and including at least one helically convoluted strip, said outer layer including a substantially cylindrical external surface having a profile composed of at least one helical groove provided in said at least one strip and extending from said external surface toward said peripheral surface, said at least one strip having at least one lip adjacent said at least one groove and being deformable in response to engagement with a running web of material which is to be expanded as a result of engagement with said external surface whereby said at least one lip reduces the dimensions of said at least one groove, said at least one strip further having two lateral surfaces substantially parallel to said at least one groove, extending between said peripheral surface and said external surface and abutting each other at least at said external surface.

2. The expander roller of claim 1, wherein said outer layer comprises said at least one helically convoluted strip and a second helically convoluted strip, said strips being substantial mirror images of each other with reference to a plane which is normal to the axis of said core.

3. The expander roller of claim 1, wherein said at least one strip has an internal surface disposed in said at least one groove adjacent said at least one lip and making an acute angle with said external surface.

4. The expander roller of claim 3, wherein said angle is between 30 and 50 degrees.

5. The expander roller of claim 1, wherein said at least one lip is adjacent side of said at least one groove and is also adjacent said external surface, said at least one groove extending from said external surface short of said peripheral surface so that said at least one lip is spaced apart from said core.

6. The expander roller of claim 5, wherein said lip has an edge adjacent said external surface and a readily deformable portion adjacent said edge.

7. The expander roller of claim 1, wherein said at least one groove has a width which decreases in a direction from said external surface toward said peripheral surface, the width of said groove at said external surface being between 0.8 and 1.5 mm.

8. The expander roller of claim 1, wherein said at least one strip has two internal surfaces which flank said at least one groove and at least one of said surfaces is straight as seen in a direction from said external surface toward said peripheral surface.

9. The expander roller of claim 1, wherein at least one lip is disposed between said at least one groove and said external surface and has a readily deformable portion adjacent said external surface, said external surface having a substantially concave portion adjacent said lip.

10. The expander roller of claim 9, wherein said at least one lip has an edge adjacent said at least one groove at said external surface, said external surface further having a main portion and said substantially concave portion being adjacent said edge and sloping gradually from said main portion toward said edge in a direction away from the axis of said core through a distance of 0.2 to 0.7 mm.

11. The expander roller of claim 1, wherein said at least one groove has a width which decreases from said external surface toward said peripheral surface, said at least one lip having a readily deformable portion adjacent said external surface, said strip further having two internal surfaces disposed in said at least one groove and one of said internal surfaces being adjacent said lip, the other of said internal surfaces being normally spaced apart from said one internal surface and said readily deformable portion of said lip being movable back and forth toward and away from said other internal surface in response to oscillation of said lip.

12. The expander roller of claim 11, wherein said internal surfaces make an acute angle.

13. The expander roller of claim 1, wherein the width of said outer layer in the radial direction of said core is less than the diameter of said core.

14. The expander roller of claim 1, wherein the width of said outer layer in the radial direction of said core is between 6 and 12 mm.

15. The expander roller of claim 1, wherein said at least one groove is machined into said at least one strip.

16. The expander roller of claim 1, wherein said external surface has a profile composed of a plurality of substantially parallel grooves.

17. The expander roller of claim 16, wherein said grooves are substantially identical.

18. The expander roller of claim 1, wherein said at least one helically convoluted strip has a lead which is a function of the characteristics of the web to be expanded by the roller.

19. The expander roller of claim 1, wherein said at least one helically convoluted strip has a lead which is a function of the diameter of said core.

20. The expander roller of claim. 1, wherein said at least one groove extends from said external surface short of said peripheral surface, said at least one strip having a portion disposed between said groove and said peripheral surface and having in the radial direction of said core a thickness in the range of 2 and 6 mm.

21. The expander roller of claim 1, wherein said at least one strip has a width of between 5 and 30 mm.

22. The expander roller of claim 1, wherein said profile is composed of a single helical groove and said at least one strip has a width of 5 to 10 mm in the axial direction of said core.

23. The expander roller of claim 1, wherein said outer layer consists of two helically convoluted strips and the lead of one of said helically convoluted strips deviates from the lead of the other of said helically convoluted strips.

24. The expander roller of claim 1, wherein said at least one strip contains an elastomeric material.

25. The expander roller of claim 24, wherein said elastomeric material is rubber.

26. The expander roller of claim 24, wherein said elastomeric material is an elastomeric plastic material.

27. The expander roller of claim 1, further comprising means for bonding said at least one strip to the peripheral surface of said core.

28. An expander roller comprising a substantially cylindrically core having a peripheral surface; and an outer layer surrounding said peripheral surface and including at least one helically convoluted strip, said outer layer including a substantially cylindrical external surface having a profile composed of at least one groove provided in said at least one strip and said at least one strip having two lateral surfaces extending between said peripheral surface and said external surface, said lateral surfaces converging toward each other in a direction from, said external surface toward said peripheral surface.

29. The expander roller of claim 28, wherein said at least one strip has a substantially trapezoidal cross-sectional outline.

30. An expander roller comprising a substantially cylindrical core having a peripheral surface; and an outer layer surrounding said peripheral surface and including at least one helically convoluted strip, said outer layer including a substantially cylindrical external surface having a profile composed of at least one helical groove and said at least one strip having two lateral surfaces extending from said external surface to said peripheral surface, said helical groove being provided in one of said lateral surfaces and extending in a direction from said external surface toward but short of said peripheral surface, said external surface having a profile composed of said at least one groove and a second helical groove substantially parallel to said at least one helical groove and extending from said external surface toward but short of the other of said lateral surfaces.

31. The expander roller of claim 21, wherein said at least one groove and said helical groove are spaced apart from each other a first distance in the axial direction of said core and said second groove is spaced apart from said other lateral surface a second distance which equals or approximates said first distance.

32. The expander roller of claim 30, wherein said at least one groove and said second groove are open at said external surface and are spaced apart at said external surface in the axial direction of said core a distance which is a function of the characteristics of the web material to be expanded by the roller.

33. The expander roller of claim 32, wherein said distance is a function of at least one of two parameters including the thickness and flexibility of the web.

34. An expander roller comprising a substantially cylindrical core having a peripheral surface; and an outer layer surrounding said peripheral surface and including at least one helically convoluted strip, said outer layer including a substantially cylindrical external surface having a profile composed of a first groove and a second groove which is provided in said external surface and extends toward but short of said peripheral surface, said at least one strip having two lateral surfaces extending from said external surface to said peripheral surface and being spaced apart a distance of 12 to 30 mm in the axial direction of said core.

35. An expander roller comprising a substantially cylindrical core having a peripheral surface; and an outer layer surrounding said peripheral surface and including at least one helically convoluted strip, said outer layer including a substantially cylindrical external surface having a profile composed of at least one helical groove formed in said at least one strip and extending longitudinally of said at least one strip as well as from said external surface toward said peripheral surface.

* * * * *